United States Patent [19]

Sturzenegger et al.

[11] 4,431,887

[45] Feb. 14, 1984

[54] GAS-BLAST SWITCH

[75] Inventors: Christian Sturzenegger, Zürich; Willi Schütz, Buchs; Bruno Aeschbach; Heinz Aeschbach, both of Reinach, all of Switzerland

[73] Assignee: Sprecher & Schuh AG, Aarau, Switzerland

[21] Appl. No.: 390,391

[22] Filed: Jun. 21, 1982

[30] Foreign Application Priority Data

Jul. 9, 1981 [CH] Switzerland ..... 4507/81

[51] Int. Cl.[3] ..... H01H 33/70

[52] U.S. Cl. ..... 200/148 A

[58] Field of Search ..... 200/148 A

[56] References Cited

U.S. PATENT DOCUMENTS 4,161,636 7/1979 Maier ..... 200/148 A

FOREIGN PATENT DOCUMENTS 2948622 12/1980 Fed. Rep. of Germany ... 200/148 A

*Primary Examiner*—Robert S. Macon

*Attorney, Agent, or Firm*—Werner W. Kleeman

[57] ABSTRACT

A movable contact element is surrounded by a co-movable blast nozzle which in the cut-on position is closed by a stationary contact element which is in engagement with the movable contact element. At its inlet side the blast nozzle is flow connected with a pump chamber or compartment which can be pressurized during the cut-off stroke. This pump chamber is constructed in a jacket or shell chamber-like fashion and bounded by an inner cylinder and an outer cylinder. The inner cylinder carries the movable contact element and the outer cylinder carries the blast nozzle. Both cylinders are displaceable by means of a stationarily supported pump piston. In order to prevent any obstruction to the flow of the extinguishing gas which is effluxing out of the pump chamber during the cut-off stroke, both of the cylinders are solely connected with one another at their ends facing away from the blast nozzle by means of a substantially ring-shaped floor member which is preferably formed at both cylinders. In the floor member there are provided at least two guide bores equipped with sliding or wiper contacts. Engaging through the guide bores is a respective electrically conductive, stationarily anchored column member supporting the pump piston.

6 Claims, 2 Drawing Figures

GAS-BLAST SWITCH

BACKGROUND OF THE INVENTION

The present invention generally relates to circuit breakers or circuit-interrupters and, more particularly, concerns a new and improved construction of gas-blast switch.

Generally speaking, the gas-blast switch of the present development is of the type containing a movable contact element and a blast nozzle which is movable conjointly with the movable contact element and surrounding such movable contact element. This blast nozzle, in the cut-on position of the gas-blast switch, is closed by a stationary contact element which engages with the movable contact element. The blast nozzle, at its inlet side, is connected with a pump chamber or compartment which can be pressurized during the cut-off stroke of the gas-blast switch. This pump chamber, in turn, possesses a jacket or shell chamber-like construction and is bounded by an inner cylinder and an outer cylinder. The inner cylinder supports the movable contact element and the outer cylinder supports the blast nozzle. Both of the cylinders can be displaced by means of a stationarily supported ring-shaped pump piston.

A gas-blast switch or circuit-interrupter of the aforementioned type is known, for instance, from U.S. Pat. No. 4,139,753, granted Feb. 13, 1979. With the prior art construction of gas-blast switch there is formed at the outer cylinder, at the region of its end closer to the blast nozzle, an inwardly directed flange-like connection part which contains passages and is secured by means of the movable contact element which is threadably connected to the inner cylinder at such inner cylinder. This connection part or element constitutes the sole mechanical connection and, accordingly, must be dimensions so as to be rather large or massive in size. Since the connection part passes through the jacket-shaped pump chamber at its outlet-side end, i.e. at that end which leads to the blast nozzle, it forms at least a restriction for the flow of the extinguishing gas which is delivered from the pump chamber to the blast nozzle because of its large or massive dimensions, notwithstanding the presence of the passages. As a result, with this state-of-the-art gas-blast switch the swept capacity or volume of the pump chamber, especially however the output of the drive moving the movable components of the switch, must be dimensions to possess an adequate size so that, during a cut-off stroke, a sufficient amount of extinguishing gas possessing an adequate flow velocity is available for blowing the switching arc between the movable contact element and the stationary contact element.

SUMMARY OF THE INVENTION

Therefore, with the foregoing in mind it is a primary object of the present invention to provide a new and improved construction of gas-blast switch which is not afflicted with the aforementioned shortcomings of the prior art construction.

Another and specific object of the present invention is directed to a new and improved construction of gas-blast switch of the previously mentioned type, wherein the displacement of the extinguishing gas out of the pump chamber, during the course of a cut-off stroke, is not hindered, so that with comparable dimensions there is improved the possible switching efficiency or output, or, however, with a given switching output it is possible to reduce the dimensions and thus the size of the drive.

Yet a further significant object of the present invention is directed to a new and improved construction of gas-blast switch which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the gas-blast switch of the present development is manifested by the features that both of the cylinders are solely connected with one another at their ends facing away from the blast nozzle by a substantially ring-shaped floor or base member at which there are provided at least two guide bores provided with sliding or wiper contacts. Engaging through each of the guide bores is a respective electrically conductive, stationarily anchored column member which supports the pump piston.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
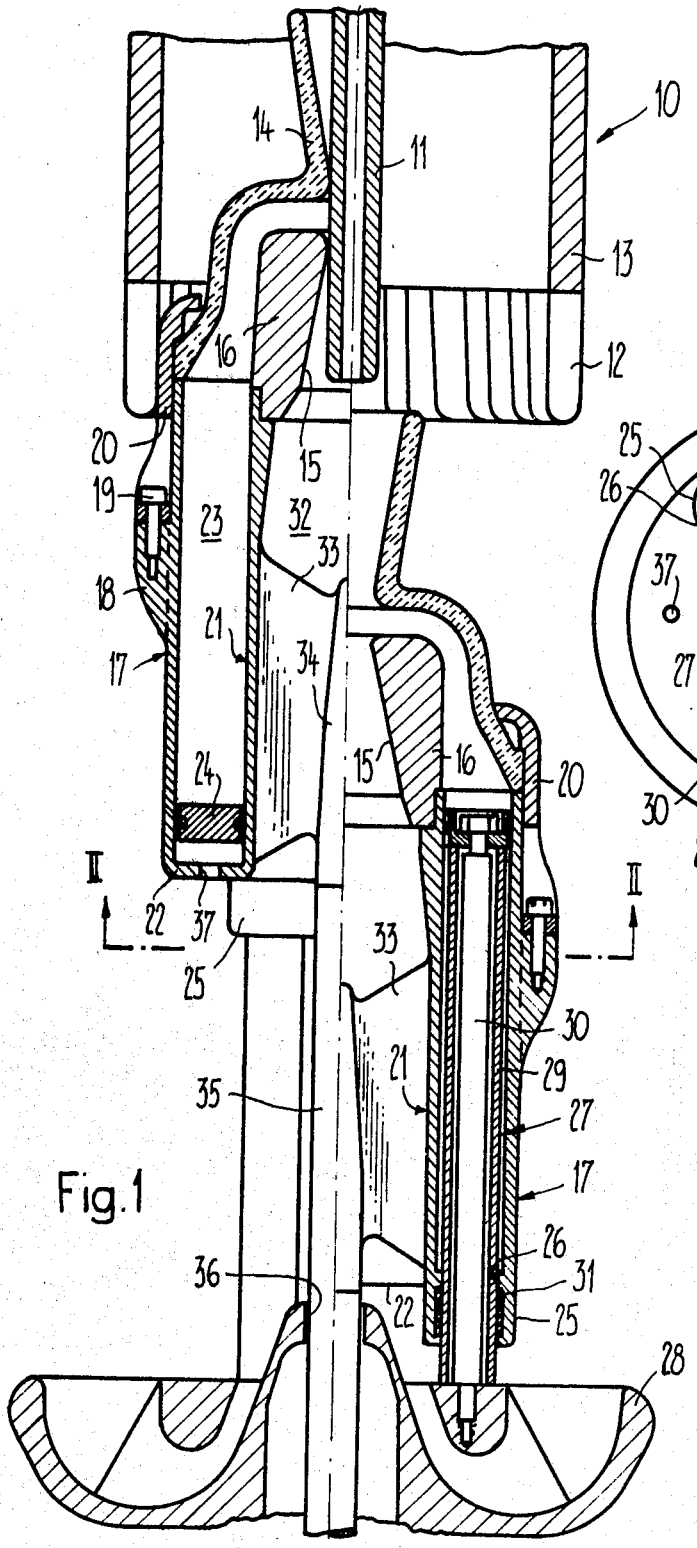
FIG. 1 is a schematic axial sectional view through the more important components of a gas-blast switch constructed according to the invention and as needed for understanding the principles thereof, with there being shown at the left-hand portion of the illustration the cut-on position and at the right-hand portion thereof the cut-off position of such switch.

Describing now the drawings, it is to be understood that to simplify the illustration thereof only enough of the construction of the exemplary embodiment of gas-blast switch has been depicted therein as needed for those skilled in the art to readily understand the underlying principles and concepts of the present development. Turning attention now specifically to FIG. 1, a set or cluster 10 of stationary contact elements is arranged in a not particularly illustrated, encapsulated switch housing containing an extinguishing gas, typically for instance $SF_6$. This set 10 of fixed contact elements contains a stationary, in the embodiment under discussion tubular-shaped break contact element 11 which is surrounded by a coaxial tubular-shaped power contact element 13 equipped at its free end with the contact fingers 12. In the cut-on position of the gas-blast switch, as shown at the left-hand side of the illustration of FIG. 1, the break contact element 11 closes a blast nozzle or blast nozzle member 14 formed of a suitable electrically insulating material and engages into a movable break contact element 16 provided with an axial passageway or passage 15.

The blast nozzle 14 is secured at its inlet-side end at an outer, electrically conductive cylinder or cylinder member 17. For this purpose there is formed a shoulder 18 approximately at one-half of the outer jacket surface of the outer cylinder 17. There is bolted or otherwise flanged to such shoulder 18, by means of the threaded bolts 19 or equivalent fastening expedients, a movable power contact element 20 which surrounds the outer cylinder 17. This power contact element 20 engages in the manner of a screw nut over the inlet side end of the blast nozzle 14, and thus, fixedly clamps such blast nozzle 14 at the upper end face of the outer cylinder 17. Equally, the contact element 20, in the cut-on position of the gas-blast switch, coacts with the contact fingers 12.

The movable break contact element 16 is secured in any suitable and therefore not particularly illustrated manner, for instance by a thread connection, with the upper end face or side of an inner cylinder 21 which is arranged coaxially with respect to the outer cylinder 17. Both of the cylinders or cylinder members 21 and 17 therefore delimit in radial direction a jacket-like or jacket chamber-like pump chamber or compartment 23 in which there is arranged a substantially ring-shaped pump piston 24 which is sealed with respect to the cylinders 17 and 21, by means of which it is possible to displace both of the cylinders 17 and 21.

Figure 2:
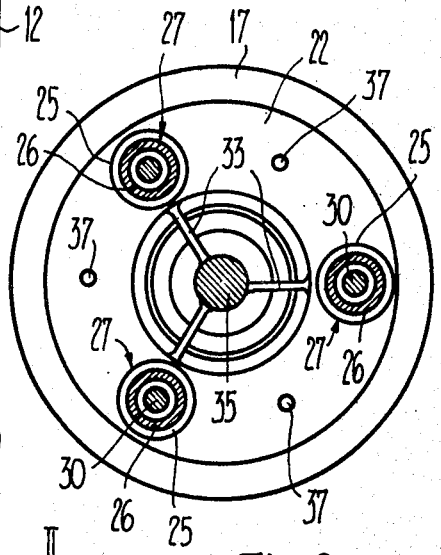
FIG. 2 is a cross-sectional view of the gas-blast switch in its cut-on position, the section being taken substantially along the line II—II of FIG. 1.

The inner cylinder 21 and the outer cylinder 17 are exclusively interconnected with one another at their ends facing away from the contact element 16 and the blast nozzle 14, respectively, by means of an essentially ring-shaped floor or base member 22. Formed at such floor or base member 22 are, for instance, as shown in the exemplary embodiment, three throughflow connections 25 which are equidistantly distributed through the same angular spacing from one another. Each of the throughflow connections 25 or equivalent structure possesses a continuous guide bore 26, as best seen by referring to FIG. 2. Extending through each guide bore 26 is a column member 27 which is anchored at its upper end at the pump piston 24. Each column member 27 possesses a sleeve member 29 formed of a suitable electrically insulating material. This sleeve member 29 is supported at one end at the side or face of the pump piston 24 which faces away from the pump chamber 23 and at its other end is supported at a conductive, stationarily arranged closure element 28. This sleeve member 29 is clamped between the closure element 28 and the pump piston 24 by means of a throughpassing traction bolt or tie rod 30 or equivalent structure. Each bore 26 is provided with a sliding or wiper contact 31 which engages at the outer surface of the sleeve member 29, so that there is established a faultless electrical connection between the connection or sleeve element 29, on the one hand, and the contact element 16 (by means of the cylinder 21) as well as the contact element 20 (by means of the cylinder 17), on the other hand. Additionally, there are provided in the floor or base member 22 a number of vent holes or openings 37 which, during a cut-off stroke of the gas-blast switch, prevent the formation of a vacuum at the side of the pump piston 24 which faces away from the pump chamber 23 and which would retard the displacement movement.

The cylinder 21 encloses a blow-out or blast channel 32 which emanates from the axial passage 15 in the contact element 16. At the inner surface of the inner cylinder 21 there are formed a plurality of support ribs or rib members 33 which extend radially towards the inside through the blast channel 32 and are connected with a substantially hub-shaped attachment portion or element 34 for instance in the form of a hub member which, in turn, is secured at the end of a drive rod 35. This drive rod 35 is displaceably quided through a central bore 36 provided at the closure element 28 and is coupled with a not particularly illustrated but conventional gas-blast switch drive.

It is believed that the advantages of the described gas-blast switch are quite evident. The extinguishing gas which as been displaced or expelled, during the cut-off stroke, by the action of the piston 24 out of the pump chamber 23, can arrive without any obstruction in its flow in the blast nozzle 14 and at that location can effectively blow the switching arc which burns between the break contact elements 11 and 16 which come out of engagement with one another after the power contact elements 13 and 20. With the described construction of gas-blast switch it is additionally possible to fabricate the outer cylinder 17, the floor portion or member 22, the inner cylinder 21, the support rib members 33 and the attachment element 34 as a single metal cast piece, something which appreciably reduces the manufacturing costs. Finally, the guiding of the movable switch components is further enhanced by the plurality of support columns or column members 27 than if such were to occur at a central tube supporting the pump piston and housing the drive rod. Additionally, that part of the heated extinguishing gas which escapes through the axial passage 15 has available a larger outflow cross-sectional area, namely the outflow channel 32 resulting in a more rapid cooling of the heated extinguishing gas.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A gas-blast switch comprising:

a movable contact element;

a blast nozzle movable in conjunction with said movable contact element and surrounding said movable contact element;

said blast nozzle having an inlet side;

a stationary contact element engaging with said movable contact element and closing said blast nozzle in a cut-on position of said gas-blast switch;

a pump chamber which can be pressurized during a cut-off stroke of the gas-blast switch and with which there is operatively connected the inlet side of the blast nozzle;

said pump chamber having a jacket-like construction and being bounded by an inner cylinder and an outer cylinder;

said inner cylinder supporting the movable contact element;

said outer cylinder supporting the blast nozzle;

a stationarily supported, substantially ring-shaped pump piston for the displacement of both cylinders;

a substantially ring-shaped floor member for interconnecting both of said cylinders solely at ends thereof facing away from said blast nozzle;

said floor member being provided with at least two guide bores;

sliding contact means provided for said at least two guide bores; and a respective electrically conductive, stationarily anchored column member supporting said piston and engaging through said guide bores.

2. The gas-blast switch as defined in claim 1, wherein:

said movable contact element contains an axial passage;

an axial throughpassing blast channel merging with the axial passage of said movable contact element;

said inner cylinder surrounding said axial throughpassing blast channel;

a drive rod; and attachment elements radially extending through said blast channel for coupling said inner cylinder with said drive rod.

3. The gas-blast switch as defined in claim 2, wherein:

said attachment element of said inner cylinder possess radially inwardly directed rib members and a hub element supporting said rib members; and said hub member being secured to said drive rod.

4. The gas-blast switch as defined in claim 3, wherein:

said outer cylinder, said ring-shaped floor member, said inner cylinder, said rib members and said hub member are formed of one piece.

5. The gas-blast switch as defined in claim 1, wherein:

each column member possesses an electrically conductive outer sleeve member;

a stationary closure element; and traction means for clamping said outer sleeve member between said pump piston and said stationary closure element.

6. The gas-blast switch as defined in claim 5, wherein:

said traction means comprises at least one traction bolt.

* * * * *